US006062970A

United States Patent [19]

Back

[11] Patent Number: 6,062,970

[45] Date of Patent: May 16, 2000

[54] STROPPING DEVICE OF BLADE FOR SAFETY RAZORS

[76] Inventor: Sung-Ho Back, Do Kok Daelim APT 102-603, 960 Do Kok-dong, Kang Nam-ku, Seoul, Rep. of Korea

[21] Appl. No.: 09/135,612

[22] Filed: Aug. 18, 1998

[30] Foreign Application Priority Data

Mar. 12, 1998 [KR] Rep. of Korea ..... 98-3602

[51] Int. Cl.[7] ..... B24D 15/08

[52] U.S. Cl. ..... 451/556; 76/DIG. 9; 76/82; 76/81.3

[58] Field of Search ..... 451/556, 552; 76/82, DIG. 8, DIG. 9, 81.3; 30/35

[56] References Cited

U.S. PATENT DOCUMENTS

| | | | |
|---|---|---|---|
| 331,853 | 12/1885 | Warren | 76/82 |
| 739,534 | 9/1903 | Doss | 76/DIG. 9 |
| 1,381,724 | 6/1921 | Maloney | 30/35 |
| 2,706,874 | 4/1955 | Carter | 451/556 |
| 5,036,731 | 8/1991 | Fletcher | 451/556 |

*Primary Examiner*—Robert A. Rose
*Attorney, Agent, or Firm*—Needle & Rosenberg, P.C.

[57] ABSTRACT

A stropping device of a blade for safety razors, capable of allowing an existing razor blade to be repeatedly used, is disclosed. The stropping device consists of a main body and an adhesive sheet attached on the back surface of the main body. A guide groove part is longitudinally formed on a front portion of the main body, while a protrusion is integrally and horizontally formed on a top portion of the main body. Also, side walls are formed at both side ends of the main body in such a manner that their outer surfaces are smoothly curved. A stropping plate member, produced from a leather material such as a natural or synthetic leather or suede, is attached on the bottom surface of the guide groove part by an adhesive means. In addition, a recess is formed on a rear portion of the protrusion in such a manner that a nail, driven in a wall in a house, is inserted into the recess.

4 Claims, 3 Drawing Sheets

STROPPING DEVICE OF BLADE FOR SAFETY RAZORS

BACKGROUND OF THE INVENTION

1. Field of the Invention

The present invention relates, in general, to a stropping device of a blade for safety razors and, more particularly, to a stropping device capable of allowing an existing razor blade to be repeatedly used, thus allowing a user to use an existing razor blade without forcing the user to change the existing razor blade with a new one when the razor blade is abraded.

2. Description of the Prior Art

As well known to those skilled in the art, a typical razor, having a knife shape, is designed for shaving hair from the face and legs. In the typical razor, when the blade of the razor is abraded, the razor is continuously used after stropping the razor blade. However, such a razor is problematic in that a user is frequently injured by the sharpened blade. Also, since the razor blade is not changed with a new one, the razor is easily fouled.

In an effort to solve the above problem, a safety razor, having a configuration capable of exchanging an existing razor blade with a new one, is proposed and widely used. In a brief description, the safety razor includes a handle and a razor blade holder mounted to one end of the handle. A push button is mounted to the other end of the handle, while a disposable razor blade is detachably mounted to the razor blade holder. Thus, when the razor blade is abraded, the abraded razor blade is easily separated from the razor blade holder by the push button, thus allowing the existing razor blade to be effectively changed with a new one.

However, the razor blade is frequently changed with a new one, thus unexpectedly increasing the exchange cost of the existing razor blade.

SUMMARY OF THE INVENTION

Accordingly, the present invention has been made keeping in mind the above problems occurring in the prior art, and an object of the present invention is to provide a stropping device of a blade for safety razors having a configuration capable of allowing an existing razor blade to be repeatedly used, thus allowing a user to use an existing razor blade without forcing the user to change the existing razor blade with a new one when the razor blade is abraded, and which reduces costs incurred by excessive blade changing.

In order to accomplish the above object, the present invention provides a stropping device of a blade for safety razors, comprising: a main body; an adhesive sheet attached on a back surface of the main body and having a removable backing paper, so that the main body is selectively attached to a wall in a house after removing the backing paper; a guide groove part longitudinally formed on a front portion of the main body in order to open at its bottom end and having a width larger than that of a razor blade; a protrusion integrally and horizontally formed on a top portion of the main body; side walls formed at both side ends of the main body in such a manner that their outer surfaces are smoothly curved in order to allow a user to feel comfortable holding the device; a stropping plate member, produced from a leather material such as a natural or synthetic leather or suede, attached on a bottom surface of the guide groove part by an adhesive means; and a recess formed on a rear portion of the protrusion in such a manner that a nail, driven in a wall in a house, is inserted into the recess.

The stropping device further comprises a cover member mounted to the main body in order to open and close over a front portion of the main body in such a manner that hinge pins provided at a lower portion of the cover member are individually inserted into holes formed on both side walls of the protrusion, respectively; and a mirror mounted on an inner surface of the cover member.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
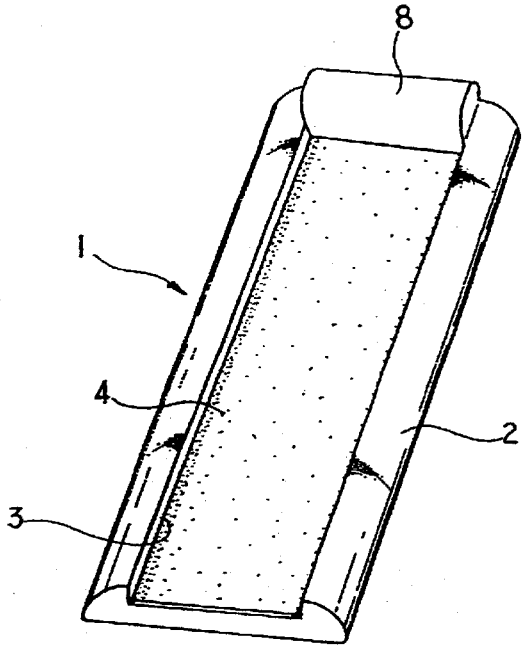
FIG. 1 is a perspective view of a stropping device of a blade for safety razors in accordance with the first embodiment of the present invention.
Figure 2:
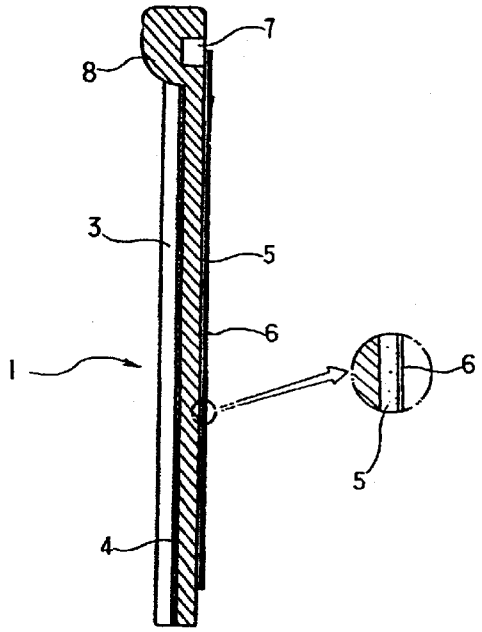
FIG. 2 is a sectional view illustrating the stropping device of FIG. 1.
Figure 3:
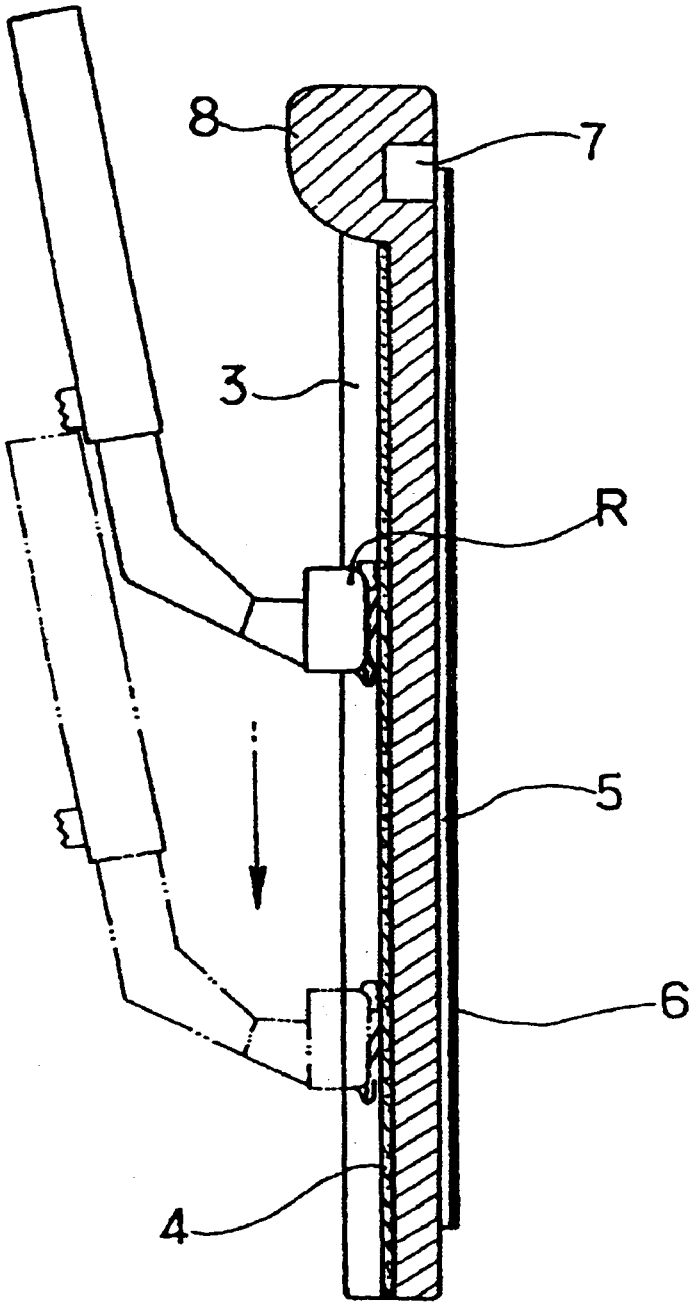
FIG. 3 is a view illustrating the using state of a safety razor applied to the stropping device of FIG. 1.

FIGS. 1 to 3 are views illustrating the construction of a stropping device of a blade for safety razors in accordance with the first embodiment of the present invention.

As shown in the drawings, the stropping device comprises a main body 1 and an adhesive sheet 5, with a removable backing paper 6, attached on the back surface of the main body 1. A guide groove part 3, having a width larger than that of a razor blade "R", is longitudinally formed on the front portion of the main body 1 in order to open at its bottom end. In addition, a protrusion 8 is horizontally and integrally formed on the top portion of the main body 1, while two side walls 2 are formed at both side ends of the main body 1. Preferably, the outer surfaces of the side walls 2 are smoothly curved in order to allow a user to feel comfortable holding the device.

A stropping plate member 4, produced from a leather material such as a natural or synthetic leather or suede, etc., is attached on the bottom surface of the guide groove part 3 by an adhesive means. Thus, the razor blade "R" is downwardly stropped along the stropping plate member 4 after abrading, thereby easily sharpening the existing razor blade "R". Also, the adhesive sheet 5 is provided with a removable backing paper 6 in order to selectively attach the main body 1 to any wall in a house after removing the backing paper 6. In addition, a recess 7 is formed on the rear portion of the protrusion 8 in such a manner that a nail, driven into a wall in a house, is inserted into the recess 7 of the main body 1.

Figure 4:
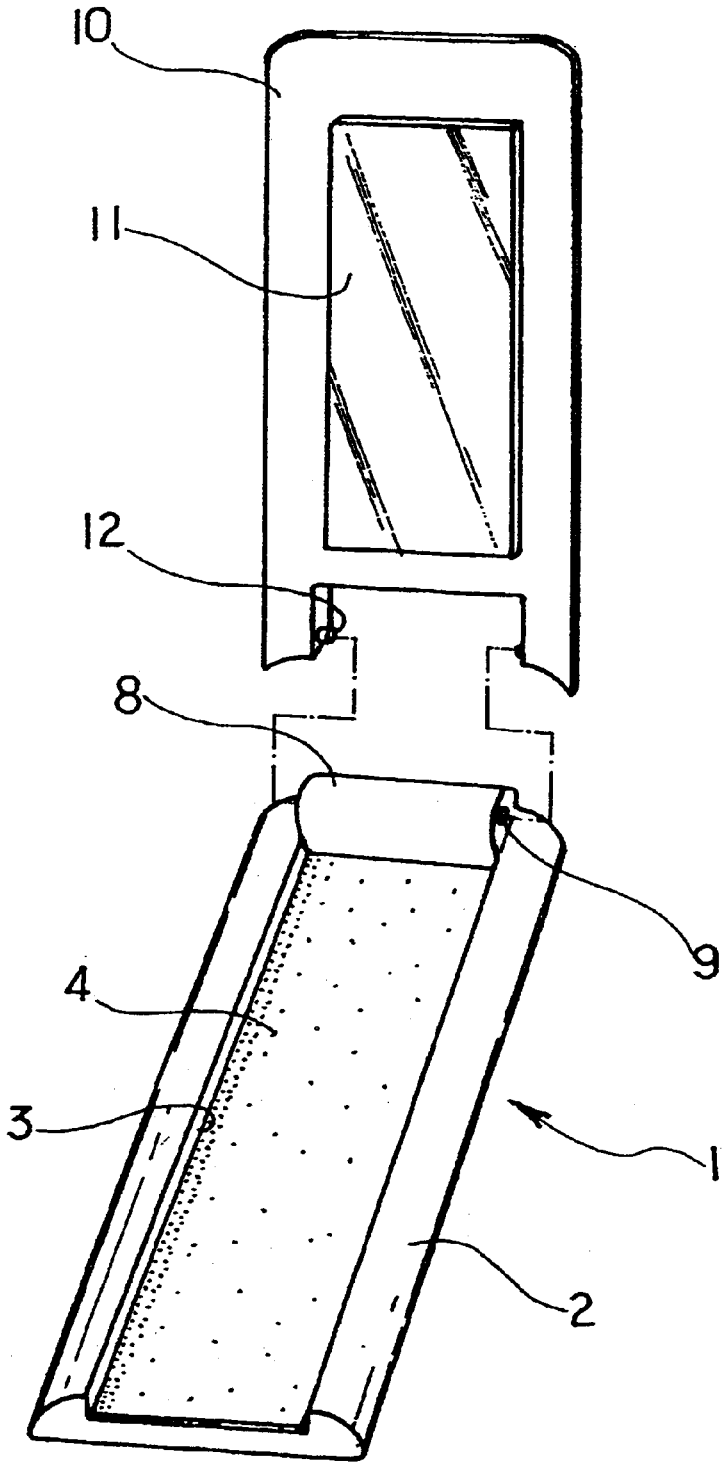
FIG. 4 is an exploded perspective view of a stropping device with a cover member in accordance with the second embodiment of the present invention.

FIG. 4 is an exploded perspective view of a stropping device with a cover member in accordance with the second embodiment of the present invention.

In this embodiment, a main body of the stropping device is identical to the main body of the above-mentioned stropping device illustrated in FIGS. 1 to 3. Thus, a description of the main body of the stropping device is not deemed necessary, but a cover member, denoted by the reference numeral 10, is mounted to the main body 1 in order to open and close over the front portion of the main body 1.

That is, the bottom end of the cover member 10 is hinged to the top end of the main body 1. In a brief description, the cover member 10 is provided with hinge pins 12 at its lower portion in such a manner that the hinge pins 12 are individually inserted into holes 9 formed on both side walls of the protrusion 8, respectively. In addition, a mirror 11 is mounted on the inner surface of the cover member 10, thus providing convenience to a user during travel or a business trip.

As mentioned above, the stropping device of this invention is provided with a configuration capable of being attached to a wall in a house or being hanged on a nail which is driven in a wall in a house. Thus, it is possible for the user to take the stropping device along during travel or a business trip.

In addition, the stropping of the razor blade is carried out in short time in such a manner that the razor blade is repeatedly drawn from the top end to the bottom end of the stropping plate member three or four times.

Furthermore, the stropping device of this invention allows a user to use an existing razor blade without forcing the user to change the existing razor blade with a new one when the razor blade is abraded.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A stropping device of a blade for safety razors, comprising:

a main body having a bottom end and two spaced-apart side ends;

an adhesive sheet attached on a back surface of said main body and having a removable backing paper, so that said main body is selectively attached to a wall in a house after removing said backing paper;

a guide groove part longitudinally formed on a front portion of said main body in order to open at the bottom end of the main body and having a width larger than that of a razor blade;

a protrusion, having two protrusion side walls, integrally and horizontally formed on a top portion of said main body;

two side walls, each having an outer surface, formed at both side ends of said main body in such a manner that each outer surface is smoothly curved in order to allow a user to feel comfortable holding the device;

a stropping plate member, produced from a leather-like material, attached on a bottom surface of said guide groove part by an adhesive means;

a recess formed on a rear portion of said protrusion in such a manner that a nail, driven in a wall in a house, is capable of being inserted into said recess;

a cover member mounted to said main body in order to open and close over a front portion of said main body in such a manner that hinge pins provided at a lower portion of said cover member are individually inserted into holes formed on each of the protrusion side walls of said protrusion, respectively; and a mirror mounted on an inner surface of said cover member.

2. The stropping device of claim 1, wherein the leather-like material comprises natural leather.

3. The stropping device of claim 1, wherein the leather-like material comprises synthetic leather.

4. The stropping device of claim 1, wherein the leather-like material comprises suede.

* * * * *